US010619654B2

(12) United States Patent
Haugsjaahabink

(10) Patent No.: US 10,619,654 B2
(45) Date of Patent: Apr. 14, 2020

(54) FAIL-FIXED HYDRAULIC ACTUATOR

(71) Applicant: Hamilton Sundstrand Corporation, Charlotte, NC (US)

(72) Inventor: Todd Haugsjaahabink, Springfield, MA (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 114 days.

(21) Appl. No.: 15/588,162

(22) Filed: May 5, 2017

(65) Prior Publication Data

US 2018/0320715 A1 Nov. 8, 2018

(51) Int. Cl.

| | |
|---|---|
| ***F15B 20/00*** | (2006.01) |
| ***F15B 9/10*** | (2006.01) |
| *F15B 13/044* | (2006.01) |
| *F15B 9/09* | (2006.01) |

(52) U.S. Cl.

CPC ..... *F15B 20/002* (2013.01); *F15B 9/10* (2013.01); *F15B 9/09* (2013.01); *F15B 13/0444* (2013.01); *F15B 2211/8623* (2013.01); *F15B 2211/8752* (2013.01)

(58) Field of Classification Search

CPC ..... F15B 9/10; F15B 13/0444; F15B 20/002; F15B 20/004

USPC ..... 60/403, 406; 91/361, 363 A, 382, 384, 91/387

See application file for complete search history.

(56) References Cited

U.S. PATENT DOCUMENTS

| | | | | |
|---|---|---|---|---|
| 3,917,430 | A * | 11/1975 | Bloom | F01D 17/26 415/26 |
| 3,956,971 | A * | 5/1976 | Meulendyk | F15B 13/16 91/384 |
| 3,977,300 | A * | 8/1976 | Sherman | F15B 13/16 91/384 |
| 4,699,355 | A | 10/1987 | Tomlin et al. | |
| 4,790,233 | A * | 12/1988 | Backe | G05B 19/231 91/361 |
| 4,987,927 | A | 1/1991 | Kluczynski | |
| 5,674,145 | A * | 10/1997 | Kidokoro | F16H 61/6648 475/192 |
| 5,735,122 | A | 4/1998 | Gibbons | |
| 6,405,758 | B1 * | 6/2002 | Hara | F16K 11/165 137/630.2 |
| 6,715,278 | B2 * | 4/2004 | Demers | F02C 9/38 60/39.281 |

(Continued)

FOREIGN PATENT DOCUMENTS

| | | |
|---|---|---|
| DE | 3836401 A1 | 5/1990 |
| GB | 1150452 A | 4/1969 |

(Continued)

OTHER PUBLICATIONS

Search Report dated Oct. 15, 2018 in U380897EP, EP Application No. 18170617.7, 9 pages.

*Primary Examiner* — Michael Leslie
(74) *Attorney, Agent, or Firm* — Cantor Colburn LLP

(57) ABSTRACT

A method of operating a fail-fixed hydraulic actuator system is provided. The method includes providing an actuator in an initial position, electromechanically operating a valve assembly to hydraulically drive actuator movement and halting the hydraulic driving of the actuator movement by the valve assembly.

18 Claims, 5 Drawing Sheets

(56) References Cited

U.S. PATENT DOCUMENTS

| | | | | |
|---|---|---|---|---|
| 6,839,617 | B2 * | 1/2005 | Mensler | F16H 61/6648 307/149 |
| 7,160,220 | B2 * | 1/2007 | Shinojima | F16H 61/6648 475/208 |
| 10,113,565 | B2 * | 10/2018 | Kopp | F15B 9/10 |
| 2008/0312025 | A1 | 12/2008 | Spickard | |
| 2016/0130988 | A1 | 5/2016 | Smith et al. | |

FOREIGN PATENT DOCUMENTS

| | | | |
|---|---|---|---|
| GB | 2118688 | A | 11/1983 |
| JP | H0849659 | A | 2/1996 |

* cited by examiner

FAIL-FIXED HYDRAULIC ACTUATOR

BACKGROUND

The following description relates to hydraulic actuators and, more particularly, to a fail-fixed hydraulic actuator system that uses a stepper motor and a pilot valve with a nulling sleeve and a method of operating a fail-fixed hydraulic actuator system.

In many engine actuator applications, an actuator is sent into or positioned in a fail-safe position in an even of an electrical failure. This fail-safe position may be an extended or retracted position. In helicopters, however, the notion of automatically positioning an actuator in a fail-safe position instead of a last-commanded position in the event of an electrical failure might not be desirable because of a need to maintain certain flight control parameters. Indeed, in at least some cases, while it is actually desirable to hold the actuator in the last commanded position instead of the fail-safe position in the event of an electrical failure, the nature of control systems of typical hydraulically powered actuators of helicopters makes doing so difficult.

BRIEF DESCRIPTION

According to one aspect of the disclosure, a method of operating a fail-fixed hydraulic actuator system is provided. The method includes providing an actuator in an initial position, electromechanically operating a valve assembly to hydraulically drive actuator movement relative to the initial position and halting the hydraulic driving of the actuator movement by the valve assembly.

In accordance with additional or alternative embodiments, the method further includes executing the electromechanical operation in accordance with the actuator movement.

In accordance with additional or alternative embodiments, the electromechanical operation includes controlling a cam with a stepper motor to assume various angular positions.

In accordance with additional or alternative embodiments, the method further includes communicating high and low pressure fluids from an engine system between the actuator and the valve assembly to hydraulically drive the actuator.

According to another aspect of the disclosure, a fail-fixed hydraulic actuator system is provided. The fail-fixed hydraulic actuator system includes an actuator disposable in an initial position, a valve assembly configured to hydraulically drive actuator movement relative to the initial position, a stepper motor assembly that initiates an hydraulic driving of the actuator movement by electromechanical operation of the valve assembly and a lever that halts the hydraulic driving of the actuator movement by the valve assembly.

In accordance with additional or alternative embodiments, the fail-fixed hydraulic actuator system further includes an electronic controller receptive of data reflecting the actuator movement and configured to instruct the stepper motor assembly to operate accordingly.

In accordance with additional or alternative embodiments, high and low pressure fluids from an engine system are communicated between the actuator and the valve assembly.

In accordance with additional or alternative embodiments, the valve assembly includes a valve and a cam disposed to assume various angular positions to open or close the valve.

In accordance with additional or alternative embodiments, the stepper motor assembly includes a stepper motor and a gear train interposed between the stepper motor assembly and the valve assembly.

In accordance with additional or alternative embodiments, the gear train includes a reduction gear.

In accordance with additional or alternative embodiments, the actuator includes a ramp and the lever is elastically biased toward a surface of the ramp.

In accordance with additional or alternative embodiments, the lever includes an axle defining a rotational axis, a first lever arm extending from the actuator to the axle and a second lever arm transversely oriented relative to the first lever arm and extending from the axle to the valve assembly.

According to another aspect of the disclosure, a fail-fixed hydraulic actuator system is provided. The fail-fixed hydraulic actuator system includes a housing, a valve including a spool movable relative to the housing in accordance with a valve state and a sleeve movable relative to the spool and an actuator. The actuator defines cavities fluidly communicative with the spool such that the actuator is hydraulically driven to move from an initial position upon a first movement of the spool relative to the housing until a second movement of the sleeve relative to the spool. The fail-fixed hydraulic actuator system further includes a cam disposed to assume various positions to change the valve state, a stepper motor assembly that electromechanically controls the cam to occupy and move between the various positions to change the valve state and to thereby drive the first movement of the spool and a lever that drives the second movement of the sleeve responsive to actuator movement.

In accordance with additional or alternative embodiments, the fail-fixed hydraulic actuator system further includes an electronic controller receptive of data reflecting the actuator movement and configured to instruct the stepper motor assembly to operate accordingly.

In accordance with additional or alternative embodiments, the high and low pressure fluids from an engine system are communicated between the cavities and ports of the spool.

In accordance with additional or alternative embodiments, the cam is disposed to assume various angular positions to open or close the valve.

In accordance with additional or alternative embodiments, the stepper motor assembly includes a stepper motor and a gear train interposed between the stepper motor and the cam.

In accordance with additional or alternative embodiments, the gear train includes a reduction gear.

In accordance with additional or alternative embodiments, the actuator includes a ramp and the lever is elastically biased toward a surface of the ramp.

In accordance with additional or alternative embodiments, the lever includes an axle defining a rotational axis, a first lever arm extending from the actuator to the axle; and a second lever arm transversely oriented relative to the first lever arm and extending from the axle to the sleeve.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

DETAILED DESCRIPTION

As will be described below, a system and method are provided to allow for tight control of a fail-fixed position in a hydraulically controlled actuator. A stepper motor controls the angular position of a cam and the cam either opens or closes a flapper/orifice in a pilot valve which in turn allows for a modulation of a control pressure acting on the pilot valve and thus moves the pilot valve. The pilot valve includes windows to port high or low pressure fluids to the actuator so that the actuator can be moved and a feedback lever on the actuator controls the position of a nulling sleeve surrounding the pilot valve. Motion of the nulling sleeve acts to close the windows as the actuator reaches a desired position that is effectively requested by the stepper motor and the pilot valve and stops motion of the actuator. A position sensor sends feedback to electronic controls which send an appropriate command to the stepper motor.

Figure 1:
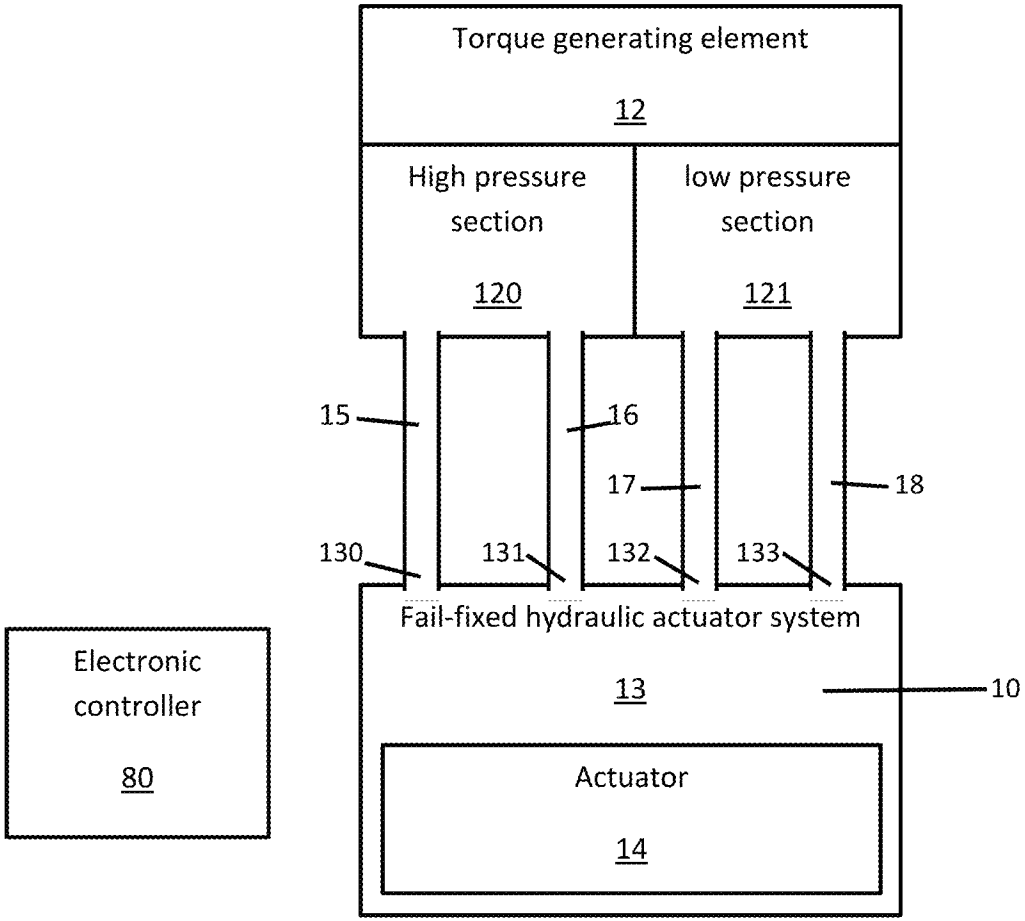
FIG. 1 is a schematic illustration of engine hydraulics of an aircraft in accordance with embodiments.
Figure 2:
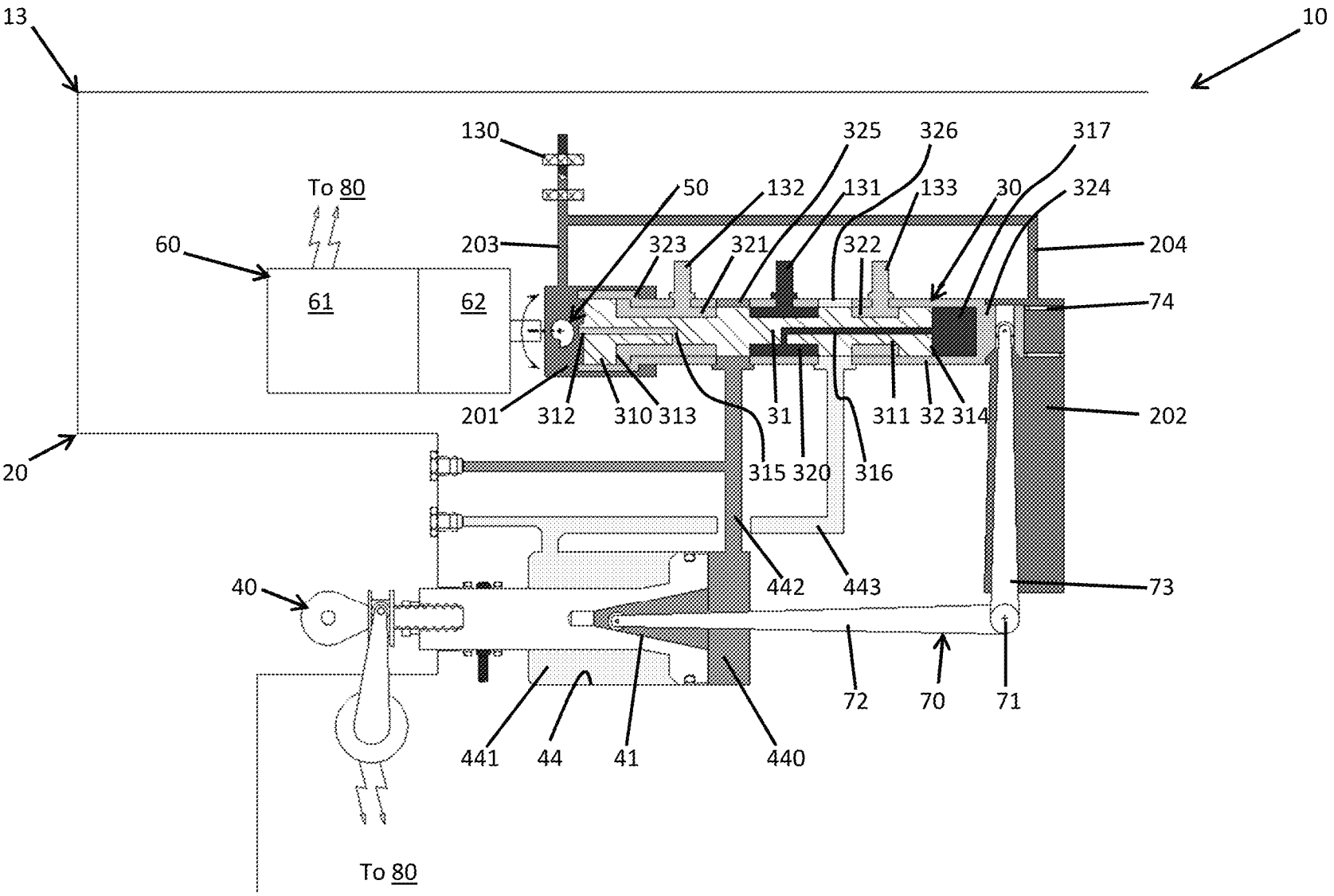
FIG. 2 is a schematic diagram illustrating a fail-fixed hydraulic actuator system of the engine hydraulics of FIG. 1 in an initial state in accordance with embodiments.

With reference to FIGS. 1 and 2, engine hydraulics 10 (see FIG. 1) may be provided for use in an aircraft, such as a helicopter. The engine hydraulics 10 include a torque generating element 12 and a fail-fixed hydraulic actuator system 13 including an actuator 14 (see FIG. 1). As shown in FIG. 1, the torque generating element 12 may be provided as an engine, for example, which includes a high pressure section 120 and a low pressure section 121. First and second high pressure lines 15 and 16 fluidly couple the high pressure section 120 to a servo orifice 130 and a high pressure inlet 131 of the fail-fixed hydraulic actuator system 13. First and second low pressure lines 17 and 18 fluidly couple the low pressure section 121 to first and second low pressure inlets 132 and 133 of the fail-fixed hydraulic actuator system 13.

Figure 3:
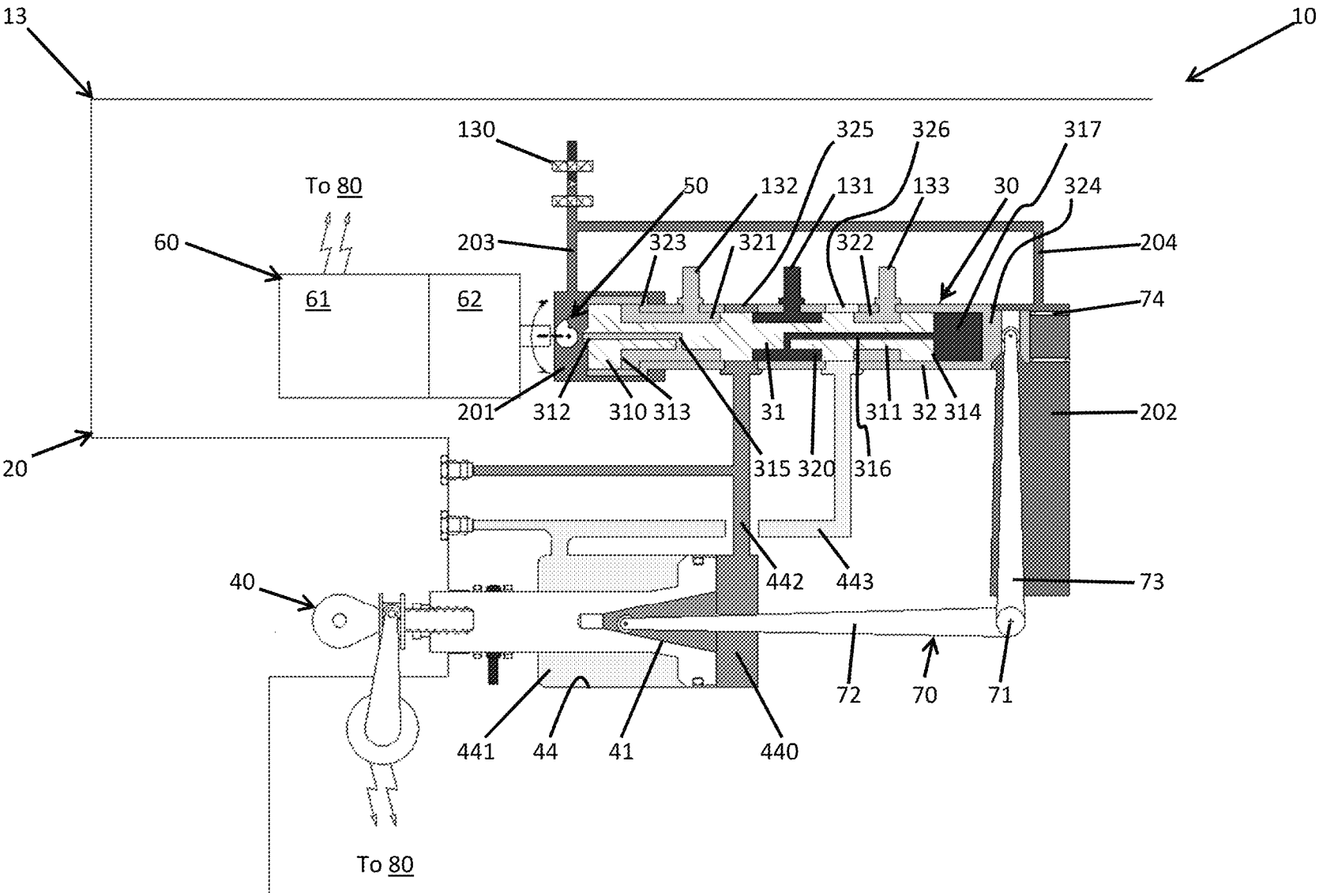
FIG. 3 is a schematic diagram illustrating a fail-fixed hydraulic actuator system of the engine hydraulics of FIG. 1 in an intermediate state in accordance with embodiments.
Figure 4:
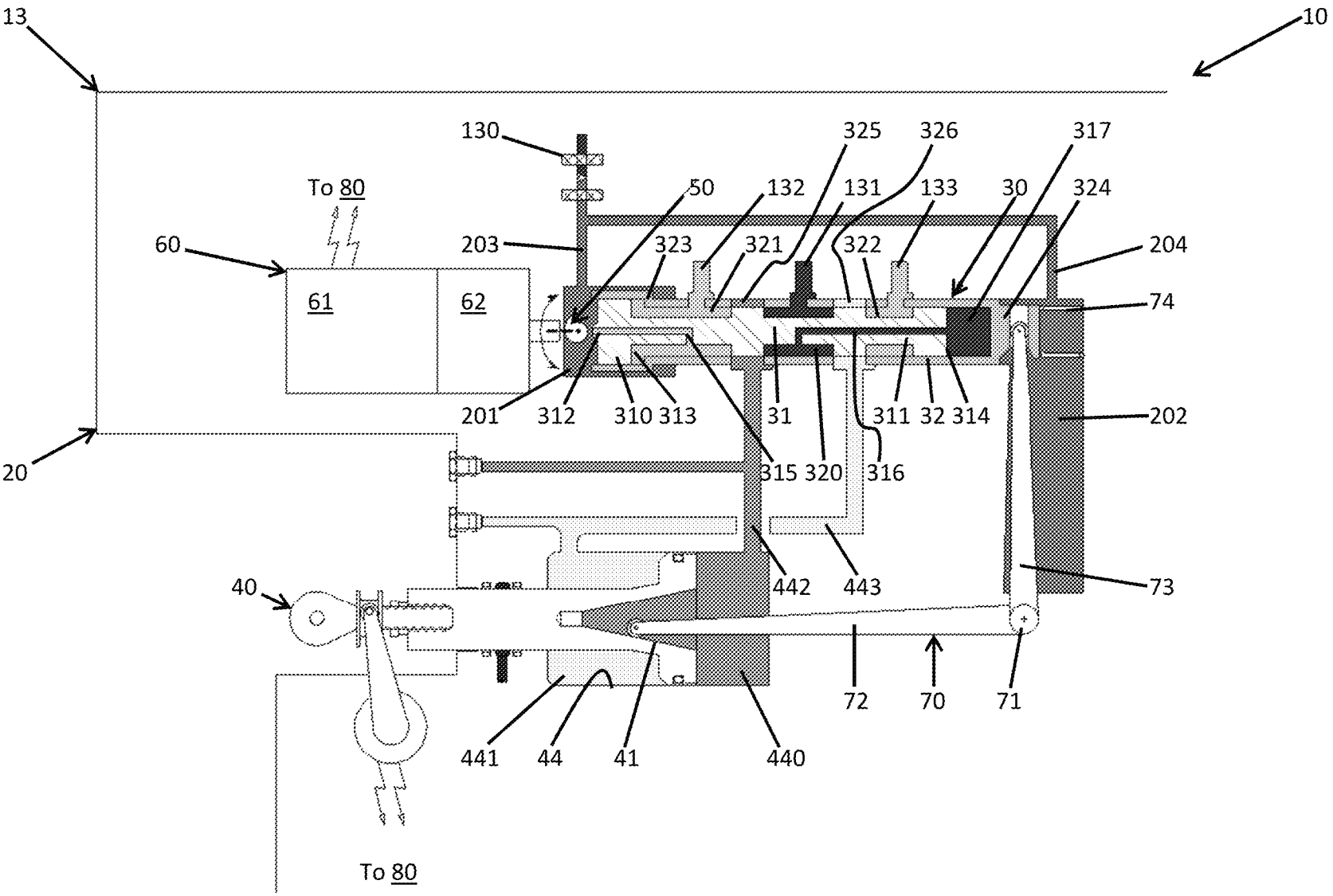
FIG. 4 is a schematic diagram illustrating a fail-fixed hydraulic actuator system of the engine hydraulics of FIG. 1 in a later state in accordance with embodiments.

With reference to FIGS. 2-4, the fail-fixed hydraulic actuator system 13 of FIG. 1 will be described in greater detail.

The fail-fixed hydraulic actuator system 13 includes a housing 20, which is formed to define a first housing cavity 201 and a second housing cavity 202. The first housing cavity 201 is fluidly coupled to the servo orifice 130 via a first line 203 and the second housing cavity 202 is fluidly coupled to the servo orifice 130 via a second line 204. High pressure fluid from the high pressure section 120 of the torque generating element 12 can thus be supplied to the first and second housing cavities 201 and 202 by way of the servo orifice 130.

The fail-fixed hydraulic actuator system 13 further includes a valve assembly 30, an actuator 40, a cam 50 a stepper motor assembly 60 and a feedback lever 70.

The valve assembly 30 may be provided as a pilot valve and includes a spool 31 and a sleeve 32. The spool 31 may be an elongate element with a first end 310 and a second end 311 that is disposed such that the first end 310 is provided within the first housing cavity 201 and the second end 311 is provided proximate to the second housing cavity 202. The spool 31 is formed to define a pilot valve opening 312 at the first end 310 and includes a shoulder surface 313 proximate to the first end 310 and an end surface 314 at the second end 311. The sleeve 32 is disposed about the spool 31 in a partially tight fitting configuration that defines a first inlet section 320, which is fluidly communicative with the high pressure inlet 131 and thus chargeable with high pressure fluid, a second inlet section 321, which is fluidly communicative with the first low pressure inlet 132 and thus chargeable with low pressure fluid, and a third inlet section 322, which is fluidly communicative with the second low pressure inlet 133 and thus chargeable with low pressure fluid. The sleeve 32 includes a shoulder section 323, which is interposed between the shoulder surface 313 of the spool 31 and a complementary surface of the first housing cavity 201 of the housing 20, and an end portion 324 interposed between the second end 311 of the spool 31 and the second housing cavity 202.

The spool 31 is further formed to define a first fluid pathway 315 and a second fluid pathway 316. The first fluid pathway 315 extends from the second inlet section 321 to the pilot valve opening 312 and is receptive of the low pressure fluid charged into the second inlet section 321 from the first low pressure inlet 132. As such, when the pilot valve opening 312 is opened, the low pressure fluid flows from the low pressure inlet 132, the second inlet section 321 and the first fluid pathway 315 into the first housing cavity 201. This results in an effective lowering of pressure in the first housing cavity 201 and the second inlet section 321. The second fluid pathway 316 extends from the first inlet section 320 to an opening in the end surface 314 so that the second fluid pathway 316 empties into space 317 between the end surface 314 and the end portion 324. The second fluid pathway 316 and the space 317 are thus receptive of the high pressure fluid charged into the first inlet section 320 from the high pressure inlet 131.

The sleeve 32 is also formed to define a first port 325 and a second port 326. The first port 325 is adjacent to the first inlet section 320 and the second port 326 is adjacent to the third inlet section 322.

During operations of the fail-fixed hydraulic actuator system 13, the spool 31 is disposed to be movable in an axial direction relative to the housing 20 in accordance with a state of the valve assembly 30. More particularly, the spool 31 is disposed to be movable in the axial direction toward to the first housing cavity 201 and away from the second housing cavity 202 in accordance with an open condition of the pilot valve opening 312. The sleeve 32 is subsequently movable in the axial direction relative to the spool 31.

The actuator 40 includes a ramp 41 and a body 44 which is formed to define a first actuator cavity 440 on a first side of the ramp 41 and a second actuator cavity 441 on a second side of the ramp 41. The actuator 40 further includes first actuator piping 442 and second actuator piping 443. The first actuator piping 442 is provided such that the first actuator cavity 440 and the first port 325 of the sleeve 32 are fluidly communicative. The second actuator piping 443 is provided such that the second actuator cavity 441 and the second port 326 of the sleeve 32 are fluidly communicative.

With this configuration, the actuator 40 may be hydraulically driven to move from an initial (or retracted) position to a second (or extended) position upon a first movement of the spool 31 relative to the housing 20 until a subsequent second movement of the sleeve 32 relative to the spool 31. That is, while the fail-fixed hydraulic actuator system 13 may be at steady-state with the actuator 40 in the initial position, as the spool 31 moves in the axial direction toward to the first housing cavity 201 and away from the second housing cavity 202, the first inlet section 320 becomes fluidly communicative with the first port 325 and the third inlet section 322 becomes fluidly communicative with the second port 326. This results in the first actuator cavity 440 having an increased pressure at the first side of the ramp 41 as compared to the second actuator cavity 441 at the second side of the ramp 41 such that the ramp 41 and the actuator 40 as a whole are hydraulically driven toward the second position.

The cam 50 may be provided as a servo cam that is rotatable about a servo cam axis to assume and move between various angular positions. These various angular positions include, but are not limited to, first and second angular positions. At the first angular position, the cam 50 restricts a flow through the pilot valve opening 312 of the low pressure fluid received in the first fluid pathway 315. At the second angular position, the cam 50 is withdrawn from the pilot valve opening 312 and permits more flow of the low pressure fluid through the pilot valve opening 312 and thus the spool 31 is forced to the left in order to again restrict the flow through the pilot valve opening 312 such that the spool 31 stops moving. This opens the ports between the second inlet section 321 and the first port 325 and between the third inlet section 322 and the second port 326 (i.e., places the valve assembly 30 in an open state).

The stepper motor assembly 60 includes a stepper motor 61 (e.g., a dual stepper motor) and a gear train 62, which may include a reduction gear and which is operably interposed between the stepper motor 61 and the cam 50. The stepper motor assembly 60 is thus configured to electromechanically control the cam 50 to occupy and move between the various angular positions thereof to thereby change the state of the valve assembly 30 and, in turn, to thereby drive the first movement of the spool 31 relative to the housing 20. That is, the stepper motor assembly 60 is configured to electromechanically control the cam 50 to rotate from the first angular position to the second angular position such that the valve assembly 30 opens, the spool 31 moves relative to the housing 20 and the actuator 40 is hydraulically driven toward the second position as described above.

The feedback lever 70 includes an axle 71, which defines a rotational axis about which the feedback lever 70 is rotatable, a first lever arm 72 and a second lever arm 73. The first lever arm 72 extends from the ramp 41 of the actuator 40 to the axle 71. The second lever arm 73 is transversely oriented relative to the first lever arm 72 and extends from the axle 71 to the end portion 324 of the sleeve 32 where a distal end of the second lever arm 73 includes a roller or sliding element that can slide relative to the end portion 324. The distal end of the first lever arm 72 includes a similar roller or sliding element that can slide along the ramp 41. The feedback lever 70 is substantially rigid such that an angle formed between the first and second lever arms 72 and 73 remains substantially constant. In addition, the first lever arm 72 is elastically biased toward the ramp 41 by, for example, elastic element 74. Thus, as the actuator 40 is hydraulically driven toward the second position, the feedback lever 70 rotates about the rotational axis of the axle 71 whereby the second lever arm 73 drives the second movement of the sleeve 32 in the axial direction relative to the spool 31. Such driving of the sleeve 32 relative to the spool 31 isolates the first and second ports 325 and 326 from the first and second actuator cavities 440 and 441 and effectively halts the hydraulic driving of the actuator 40.

The fail-fixed hydraulic actuator system 13 further includes an electronic controller (or ECC) 80 (see FIG. 1). The electronic controller 80 is electrically communicative with the actuator 40 and the stepper motor assembly 60. As such, the electronic controller is receptive of data, which is reflective of movements of the actuator 40 (e.g., whether the actuator 40 is in the initial or second position), from the actuator 40 and configured to instruct the stepper motor assembly 60 to operate in accordance with the data.

Operations of the fail-fixed hydraulic actuator system 13 will now be described with continued reference to FIGS. 2-4.

At an initial state and time, as shown in FIG. 2, the fail-fixed hydraulic actuator system 13 is at steady state with the actuator 40 not yet moving from the initial position, the valve assembly 30 closed by the cam 50 being in the first angular position and the first and second ports 325 and 326 closed and isolated from the high and low pressure fluid. At an intermediate state and time, as shown in FIG. 2, the stepper motor assembly 60 electromechanically rotates cam 50 to assume the second angular position and to open the valve assembly 30. This effectively lowers pressures in the first housing cavity 201 and the second inlet section 321 such that the spool 31 moves in the axial direction toward the first housing cavity 201 until pressures in the first housing cavity 201 return and such that high and low pressure fluids are communicated between the first and second ports 325 and 326 and the first and second actuator cavities 440 and 441, respectively, to hydraulically drive the actuator 40 toward the extended position. At a later state and time, the movement of the actuator 40 causes the feedback lever 70 to rotate and to drive the movement of the sleeve 32 relative to the spool 31 to thereby isolate the first and second ports 325 and 326 from the first and second actuator cavities 440 and 441, respectively, and effectively halts the hydraulic driving of the actuator 40.

Figure 5:
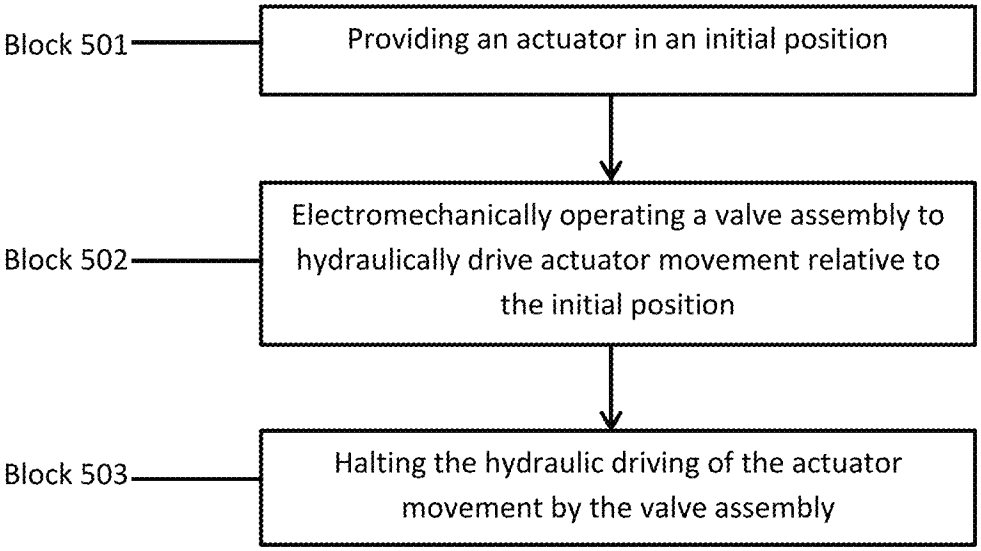
FIG. 5 is a flow diagram illustrating a method of operating a fail-fixed hydraulic actuator system in accordance with embodiments.

With reference to FIG. 5, a method of operating the fail-fixed hydraulic actuator system 13 described above is provided. As shown in FIG. 5, the method includes providing the actuator 40 in an initial position (block 501). The method further includes, electromechanically operating the valve assembly 30 by controlling the cam 50 with the stepper motor assembly 60 to assume various angular positions at least partially in accordance with the movement of the actuator 40 in order to communicate high and low pressure fluids from an engine system between the actuator 40 and the valve assembly 30 and to thereby hydraulically drive the movement of the actuator 40 relative to the initial position (block 502). In addition, the method includes halting the hydraulic driving of the movement of the actuator 40 by the valve assembly 30 (block 503).

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A method of operating a fail-fixed hydraulic actuator system, the method comprising:

providing an actuator in an initial position;

electromechanically operating a valve assembly to hydraulically drive actuator movement relative to the initial position; and halting the hydraulic driving of the actuator movement by the valve assembly, wherein:

the actuator comprises:

a ramp toward which a lever configured to execute the halting is elastically biased;

a body defining cavities on opposite sides of the ramp; and piping fluidly communicative with the cavities, and the valve assembly increases pressure in the cavities via the piping to hydraulically drive the actuator movement.

2. The method according to claim 1, further comprising executing the electromechanically operating in accordance with the actuator movement.

3. The method according to claim 1, wherein the electromechanical operation comprises controlling a cam with a stepper motor to assume various angular positions.

4. The method according to claim 1, further comprising communicating high and low pressure fluids from an engine system between the cavities of the actuator and the valve assembly via the piping to hydraulically drive the actuator.

5. A fail-fixed hydraulic actuator system, comprising:

an actuator disposable in an initial position;

a valve assembly configured to hydraulically drive actuator movement relative to the initial position;

a stepper motor assembly that initiates an hydraulic driving of the actuator movement by electromechanical operation of the valve assembly; and a lever that halts the hydraulic driving of the actuator movement by the valve assembly, wherein:

the actuator comprises a ramp toward which the lever is elastically biased, a body defining cavities on opposite sides of the ramp and piping fluidly communicative with the cavities, and the valve assembly increases pressure in the cavities via the piping to hydraulically drive the actuator movement.

6. The fail-fixed hydraulic actuator system according to claim 5, further comprising an electronic controller receptive of data reflecting the actuator movement and configured to instruct the stepper motor assembly to operate accordingly.

7. The fail-fixed hydraulic actuator system according to claim 5, wherein:

the cavities comprise first and second cavities at first and second sides of the ramp, respectively, the piping comprises first and second piping fluidly communicative with the valve assembly and the first and second cavities, respectively, and high and low pressure fluids from an engine system are communicated between the first and second cavities of the actuator and the valve assembly via the first and second piping, respectively.

8. The fail-fixed hydraulic actuator system according to claim 5, wherein the valve assembly comprises:

a valve; and a cam disposed to assume various angular positions to open or close the valve.

9. The fail-fixed hydraulic actuator system according to claim 5, wherein the stepper motor assembly comprises:

a stepper motor; and a gear train interposed between the stepper motor assembly and the valve assembly.

10. The fail-fixed hydraulic actuator system according to claim 9, wherein the gear train comprises a reduction gear.

11. The fail-fixed hydraulic actuator system according to claim 5, wherein the lever comprises:

an axle defining a rotational axis;

a first lever arm extending from the actuator to the axle; and a second lever arm transversely oriented relative to the first lever arm and extending from the axle to the valve assembly.

12. A fail-fixed hydraulic actuator system, comprising:

a housing;

a valve comprising a spool movable relative to the housing in accordance with a valve state and a sleeve movable relative to the spool;

an actuator comprising a ramp, a body defining first and second cavities at first and second sides of the ramp, respectively, and first and second piping by which the first and second cavities are fluidly communicative with the spool, respectively, such that the actuator is hydraulically driven to move from an initial position upon a first movement of the spool relative to the housing until a second movement of the sleeve relative to the spool;

a cam disposed to assume various positions to change the valve state;

a stepper motor assembly that electromechanically controls the cam to occupy and move between the various positions to change the valve state and to thereby drive the first movement of the spool; and a lever that is elastically biased toward the ramp and which drives the second movement of the sleeve responsive to actuator movement.

13. The fail-fixed hydraulic actuator system according to claim 12, further comprising an electronic controller receptive of data reflecting the actuator movement and configured to instruct the stepper motor assembly to operate accordingly.

14. The fail-fixed hydraulic actuator system according to claim 12, wherein high and low pressure fluids from an engine system are communicated between the first and second cavities and ports of the spool via the first and second piping, respectively.

15. The fail-fixed hydraulic actuator system according to claim 12, wherein the cam is disposed to assume various angular positions to open or close the valve.

16. The fail-fixed hydraulic actuator system according to claim 12, wherein the stepper motor assembly comprises:

a stepper motor; and a gear train interposed between the stepper motor and the cam.

17. The fail-fixed hydraulic actuator system according to claim 16, wherein the gear train comprises a reduction gear.

18. The fail-fixed hydraulic actuator system according to claim 12, wherein the lever comprises:

an axle defining a rotational axis;

a first lever arm extending from the actuator to the axle; and a second lever arm transversely oriented relative to the first lever arm and extending from the axle to the sleeve.

* * * * *